US006995781B2

(12) United States Patent
Matsushiro et al.

(10) Patent No.: US 6,995,781 B2
(45) Date of Patent: Feb. 7, 2006

(54) PRINT HEAD AND IMAGE FORMING APPARATUS

(75) Inventors: Nobuhito Matsushiro, Tokyo (JP); Kazuyo Watanabe, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/648,383

(22) Filed: Aug. 27, 2003

(65) Prior Publication Data

US 2004/0090515 A1 May 13, 2004

(30) Foreign Application Priority Data

Aug. 28, 2002 (JP) ..... 2002-248502

(51) Int. Cl.
*B41J 2/385* (2006.01)
*G03G 13/04* (2006.01)

(52) U.S. Cl. ..... 347/130; 347/132; 347/237; 347/238

(58) Field of Classification Search ..... 347/129, 347/130, 233, 234, 238, 132, 237, 247
See application file for complete search history.

(56) References Cited

U.S. PATENT DOCUMENTS 4,435,064 A * 3/1984 Tsukada et al. ..... 355/1
4,575,739 A * 3/1986 De Schamphelaere et al. .. 347/237
4,589,745 A * 5/1986 Plummer ..... 396/548
5,258,629 A * 11/1993 Itoh et al. ..... 257/88
6,002,420 A * 12/1999 Tanioka et al. ..... 347/237
6,215,511 B1 * 4/2001 Asako et al. ..... 347/234
6,563,526 B1 * 5/2003 Sekiya et al. ..... 347/237

* cited by examiner

*Primary Examiner*—Andrew H. Hirshfeld
*Assistant Examiner*—Leo T. Hinze
(74) *Attorney, Agent, or Firm*—Takeuchi&Kubotera,LLP

(57) ABSTRACT

A print head comprises a plurality of light emitting devices which are arranged such that the adjacent light emitting devices are stepped from each other in the rotation direction of a photosensitive member, or a plurality of light emitting devices which are disposed linearly such that the light emitting devices emit light at different timings each other by employing a delay mechanism. Consequently, it is possible to provide the output pattern capable of directing the human eyes in two dimensions so as to reduce the visible difference in the image density.

9 Claims, 9 Drawing Sheets

(b)

(a)

PRINT HEAD AND IMAGE FORMING APPARATUS

BACKGROUND OF THE INVENTION

1. Field of the Invention

The present invention relates to an image forming apparatus, such as an copying machine, printer, and facsimile machine, using a print head including a plurality of light emitting devices, and a print head used in such an apparatus.

2. Description of the Related Art

The image forming apparatus, such as a printer, using the electro-photographic system comprises an exposing device for exposing a photo-sensitive member by a light source, such as an LED, to form on the photo-sensitive member an electrostatic latent image which is to be developed.

FIG. 7 shows an LED head containing an LED array chip for an exposing device used in a conventional image forming apparatus. In an example of FIG. 7, a plurality of LEDs 1*a* linearly arranged in a longitudinal direction of a rectangular LED array chip 1. This array chip produces a linear output pattern in a main scanning direction. It has six hundreds of LEDs 1*a* arranged per inch for the image forming apparatus having a resolution of 600 dpi.

The LEDs 1*a* of the LED array chip 1 have different luminous strengths because of ununiformity of characteristics caused by the manufacturing tolerance. The different luminous strengths can cause ununiform image density, resulting in the poor print quality.

FIG. 8 shows an output pattern of image simulation of a conventional image forming apparatus. In an example of FIG. 8, there is a significant difference in the size of dots between the third and fourth columns of dots from the right of the drawing in each dot row extending in a horizontal direction corresponding to the respective LEDs 1*a*. The difference of the dot size is caused by different luminous energies of the respective LEDs 1*a*. This difference in the third and fourth columns of dots produces a belt pattern around the fourth column, which has a density lower than that of the periphery thereof because of the relatively low ratio of black area per unit area. This belt pattern is caused by the different image density and readily recognized by the eyes as a pattern having a strong directivity.

SUMMARY OF THE INVENTION

Accordingly, it is an object of the present invention to provide an image forming apparatus which reduces the difference in the image density that is easily visible.

A print head according to the invention comprises a plurality of light emitting devices disposed at such positions as to make exposure at substantially equal intervals in a main scanning direction and adjacent devices of the light emitting devices are disposed in a stepped-fashion in a sub-scanning direction perpendicular to the main scanning direction.

The extent of the stepped-fashion may be determined such that the stepped-fashion provides spatial frequency characteristics exceeding a specific spatial frequency, wherein the spatial frequency characteristics may be determined by distances in the main scanning direction between one of the light emitting device and the others of the light emitting devices and positioning differences in the sub-scanning direction between the one of the light emitting devices and the others of the light emitting devices.

The spatial frequency characteristics may have a predetermined frequency band width. The spatial frequency characteristics may have characteristics of a blue noise.

The spatial frequency characteristics may have characteristics of line spectrum noises indicating specific spatial frequencies.

An image forming apparatus according to the invention comprises a photosensitive member and a print head including a plurality of light emitting devices for emitting light to the photosensitive member so as to form an electrostatic latent image on the photosensitive member in a main scanning direction. Each of the light emitting devices is arranged in a stepped-fashion with respect to each other in a sub-scanning direction perpendicular to the main scanning direction.

DESCRIPTION OF THE PREFERRED EMBODIMENT (First Embodiment)

Figure 1:
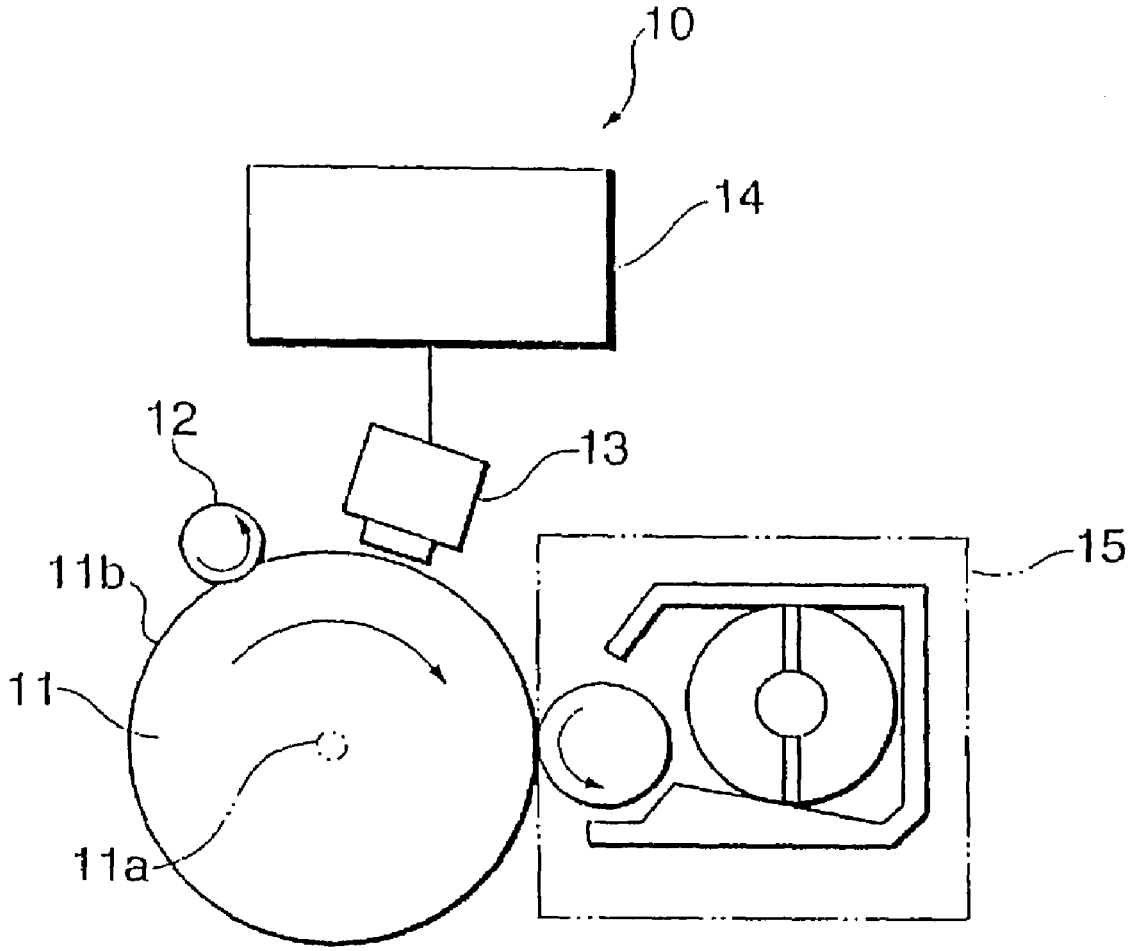
FIG. 1 is a schematic diagram of an image forming apparatus according to the present invention.
Figure 2:
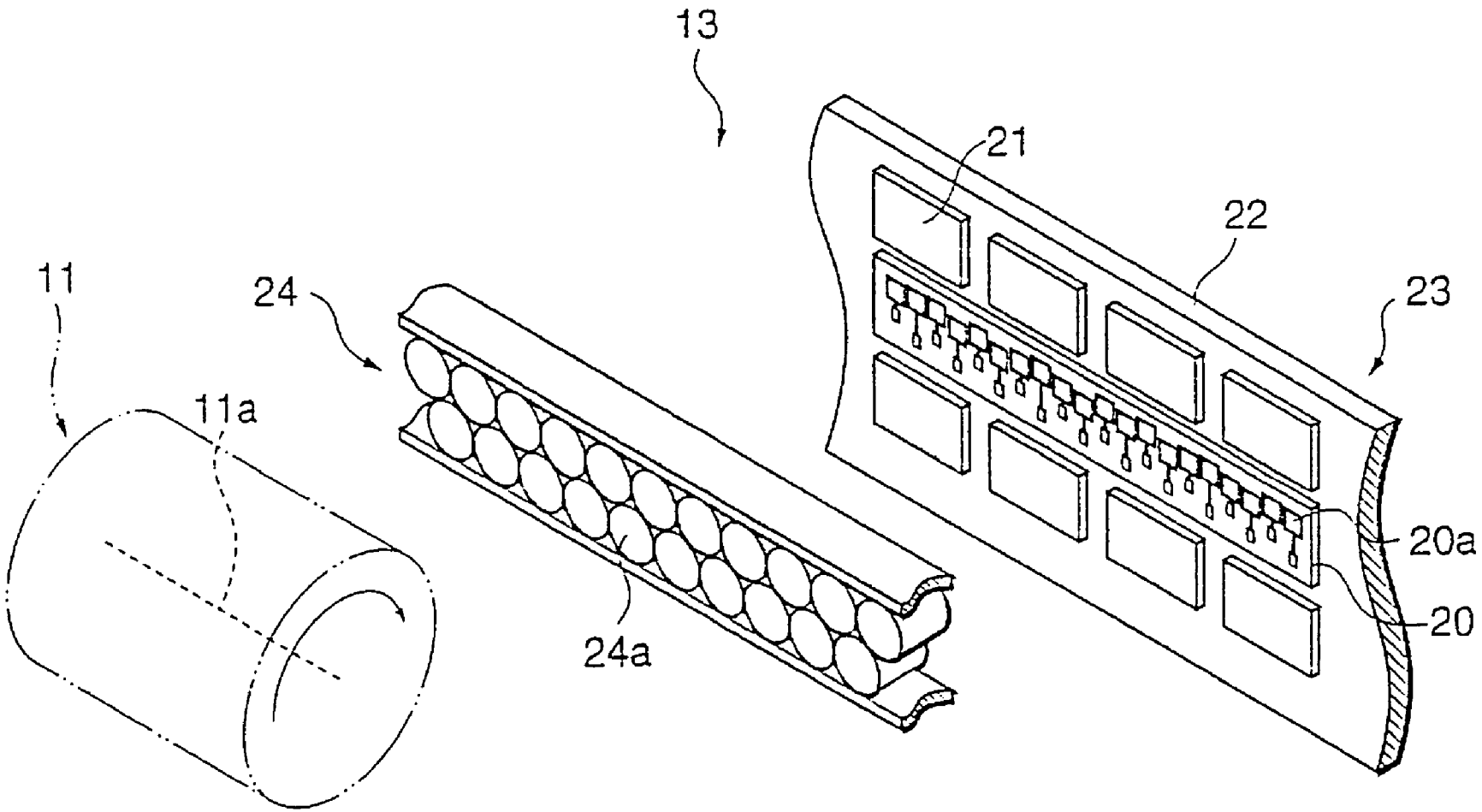
FIG. 2 is an exploded perspective view of a print head according to the first embodiment of the invention.

In FIG. 1, an image forming apparatus 10 according to the first embodiment comprises a cylindrical photo-sensitive member 11 rotatable about a rotation axis 11*a* in a predetermined direction, a charging device 12 for charging a side surface 11*b* of the photo-sensitive member 11 in a main scanning direction in parallel to the rotation axis 11*a*, a print head 13 for emitting exposure light to the photo-sensitive member 11 so as to form electrostatic latent image on the side surface 11*b* of the photo-sensitive member 11, a drive circuit 14 to control a driver chip 21 (FIG. 2) of the print head 13, and a development device 15 for supplying toner to develop the electrostatic image formed on the photo-sensitive member 11.

The photosensitive member 11 rotates in a clockwise direction in the example of FIG. 1 and the side surface 11*b* is charged by the charging device 12. The charged side surface 11*b* is exposed to the light emitted by the print head 13 so that the electrostatic latent image to be developed is formed corresponding to image.

Self-light-emitting type devices, such as light emitting diodes (LEDs) or electroluminescences (ELs), are used widely in the print head. However, such devices may be replaced by a liquid crystal device that selectively transmit light from a separately provided light source. In this embodiment, LEDs are used.

The print head 13 comprises an LED board 23 and a lens array 24. A rectangular LED array chip 20 including a plurality of LEDs 20*a* and a plurality of driver chips 21 for driving the respective LEDs 20*a* is mounted on a board 22 of the LED board 23. The lens array 24 comprises a plurality of self-image-formation type lenses 24*a* for projecting the exposure light from the LED board 23 onto the photosensitive member 11.

A plurality of LEDs 20*a* are arranged on the LED array chip 20 in the longitudinal direction or main scanning direction along the rotation axis 11*a* of the photo-sensitive member 11. Six hundreds (600) per inch of the LEDs 20*a* are provided on the LED array chip 20 for the image forming apparatus 10 having a resolution of 600 dpi (dots per inch).

Figure 3:
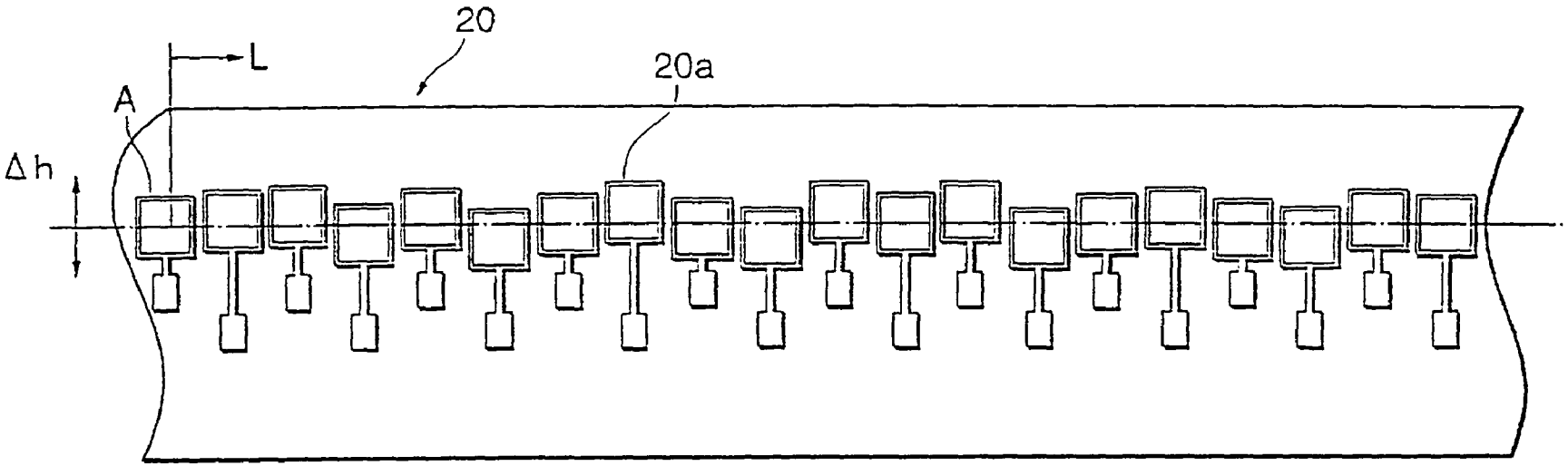
FIG. 3 is a schematic diagram of an LED arrangement according to the first embodiment.

FIG. 3 shows the arrangement of the LEDs 20*a* on the LED array chip 20, which shows the characteristics of the present invention. That is, the respective adjacent LEDs 20*a* are disposed in a stepped-fashion in a sub-scanning direction which is perpendicular to the main scanning direction.

The degree of the stepped-fashion is determined according to the below-mentioned noise having the frequency characteristics shown in FIG. 5(*a*) or 5(*b*).

Figure 4:
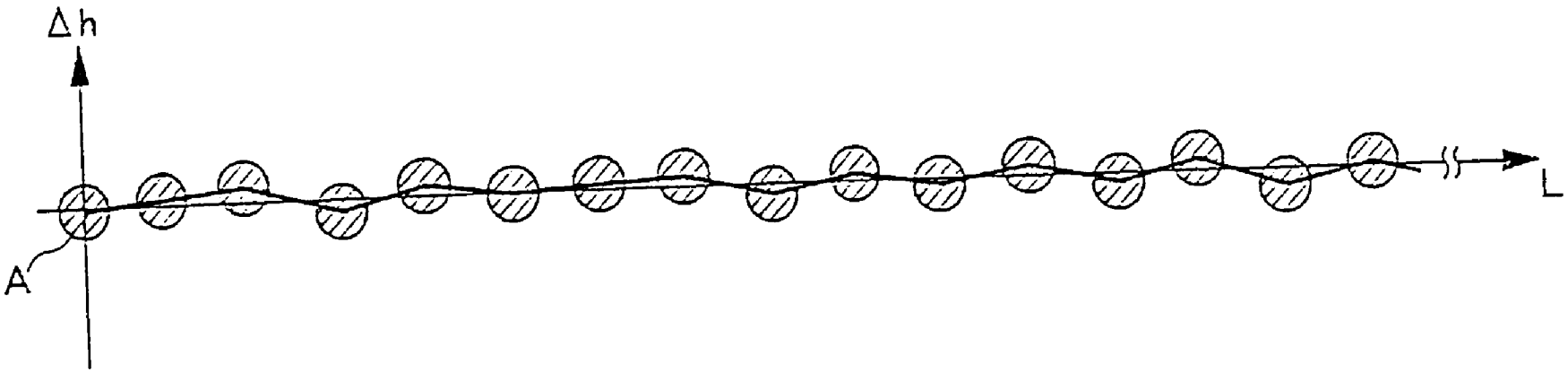
FIG. 4 is a schematic diagram showing characteristics of the LED arrangement according to the first embodiment.

In FIG. 3, the respective LEDs 20*a* are arranged on the LED array chip 20 such that the LEDs 20*a* other than the reference LED 20*a* at a position A have such noise characteristics as stated above. The relationship between a distance L, which is a distance from the position A of the reference LED 20*a* to the other LEDs 20*a* in the main scanning direction or longitudinal direction of the LED array chip 20, and a positioning difference Δh from the position A in the sub-scanning direction, is shown in FIG. 4. As shown in FIG. 4, the positioning difference Δh has discrete values corresponding to the distance L. A row of sampled values or the respective discrete values is subject to discrete Fourier transformation to provide the frequency characteristics of the arrangement of LEDs 20*a*. According to the embodiment, the respective LEDs 20*a* are arranged such that the frequency characteristics thereof are consistent with the noise frequency characteristics shown in FIG. 5(*a*) or 5(*b*).

It is well known that the human eyes are hardly sensitive to high frequencies above a specific spatial frequency. There is a blue noise in such a high-frequency region, which has the frequency characteristics of a certain frequency band width. The characteristics of the blue noise are shown in FIG. 5(*a*). The above-mentioned step provided between the respective LEDs 20*a* is determined according to the blue noise which has the frequency characteristics in the high-frequency region where the human eyes are not sensitive.

Figure 5B:
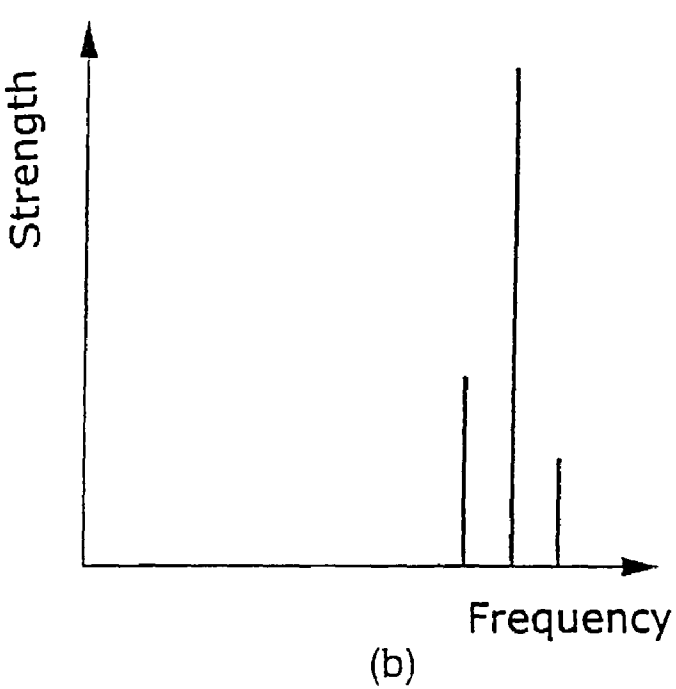
FIGS. 5(*a*) and 5(*b*) are graphs showing frequency characteristics of the LED arrangement according to the first embodiment.
Figure 5A:
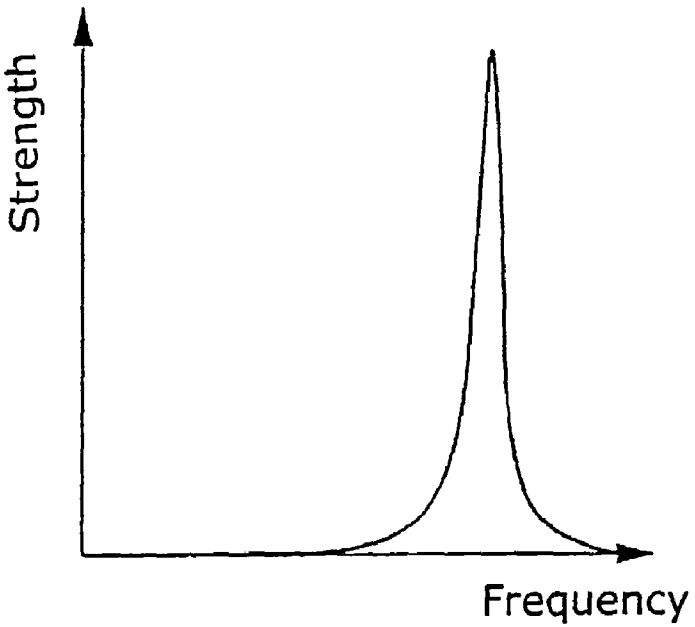

Alternatively, a line spectrum noise, which has a specific frequency component in the high-frequency region and the frequency characteristic shown in FIG. 5(*b*), may be used for the blue noise. The line spectrum noise having three specific frequency components is shown in FIG. 5(*b*).

Figure 6:
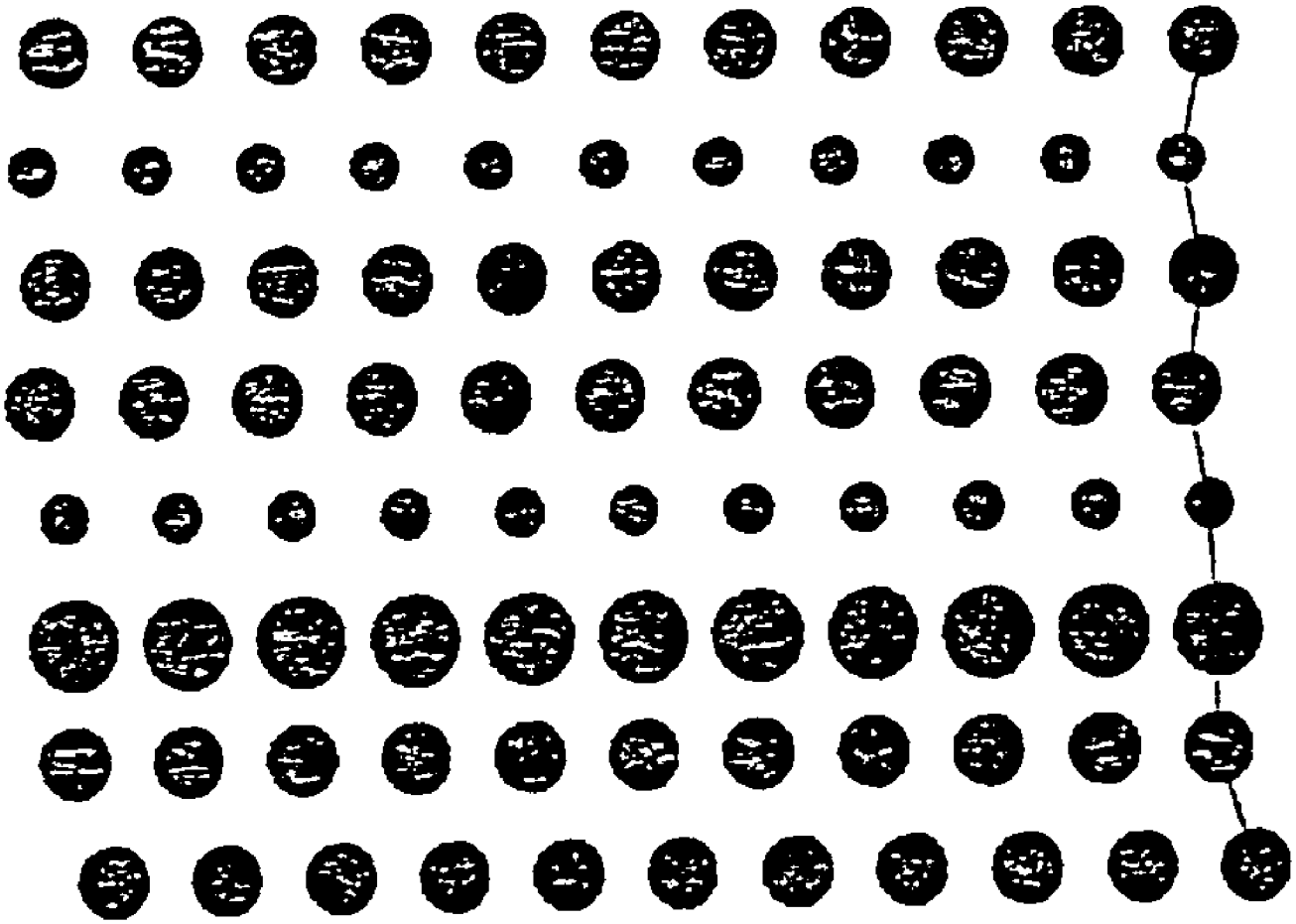
FIG. 6 is a schematic diagram showing an output pattern of the image forming apparatus according to the first embodiment.

In FIG. 6, since the respective LEDs 20*a* are arranged in the stepped-fashion according to the embodiment, the respective dots I each row in the horizontal direction of the output pattern have steps corresponding to the arrangement of the LEDs 20*a*. However, the respective dots in each column in the vertical direction are positioned in a straight line without any step or fluctuation.

The linear pattern of the vertical dots is easy for the human eyes to catch because it has strong directivity. When the fluctuated pattern of the horizontal dot groups is added, the human eyes are drawn to the horizontal direction as well as the vertical direction.

Consequently, even when different dot sizes appear in the adjacent vertical dot groups because of the different luminous energies of the respective LEDs 20*a*, it is possible to reduce the visible difference of the image density caused by the different dot sizes because the human eyes are attracted in two directions. For example, although the dot sizes in the third and fourth columns in the output pattern in FIG. 6 are very different, the difference in the image density between the two columns becomes less remarkable when the whole output pattern is seen from far away.

It is concerned that the developed image is disarrayed because of the steps in each row as shown in FIG. 6. However, the horizontal disarray has no visible influence since the well known half-tone treatment has been performed prior to the exposure process by an image treatment apparatus (not shown) using a screen having a resolution lower than the above-mentioned step.

As described above, the image forming apparatus 10 comprises the LEDs 20*a* on the LED array chip 20, which are arranged in the stepped-fashion determined according to a high-frequency noise, such as the blue noise, so that the output pattern appears in the stepped-fashion in the horizontal direction. Consequently, according to the image forming apparatus 10 in the first embodiment, the human eyes are directed in two dimensions so that it is possible to reduce the visible difference in the image density in the vertical direction caused by the different luminous energies of the respective LEDs 20*a*.

As shown in FIG. 3, the adjacent LEDs 20*a* are arranged in a stepped-fashion according to this embodiment. However, the stepped-fashion is not limited to the example in FIG. 3, as far as the step is determined according to the above-mentioned high-frequency noise. For example, a step may be provided between pairs of the LEDs 20*a* or a step may be provided between a pair of the LEDs 20*a* and a single LED 20*a* arranged between two pairs of the LEDs 20*a*.

The image forming apparatus 10 according to the embodiment includes a copying machine, printer, and facsimile machine using the electro-photographic system.

(Second Embodiment)

In the first embodiment, a plurality of the LEDs 20*a* are arranged in the stepped-fashion. The stepped output pattern is effected by another way. For example, if a plurality of LEDs 20*a* are arranged linearly and such a mechanism is provided as to make the respective LEDs 20*a* emit light at a predetermined individual timing, not at the same timing, the stepped output pattern is provided.

An image forming apparatus 50 in the second embodiment comprises an identical structure to that of the first embodiment except for an image forming apparatus 10 and a print head 53.

Figure 7:
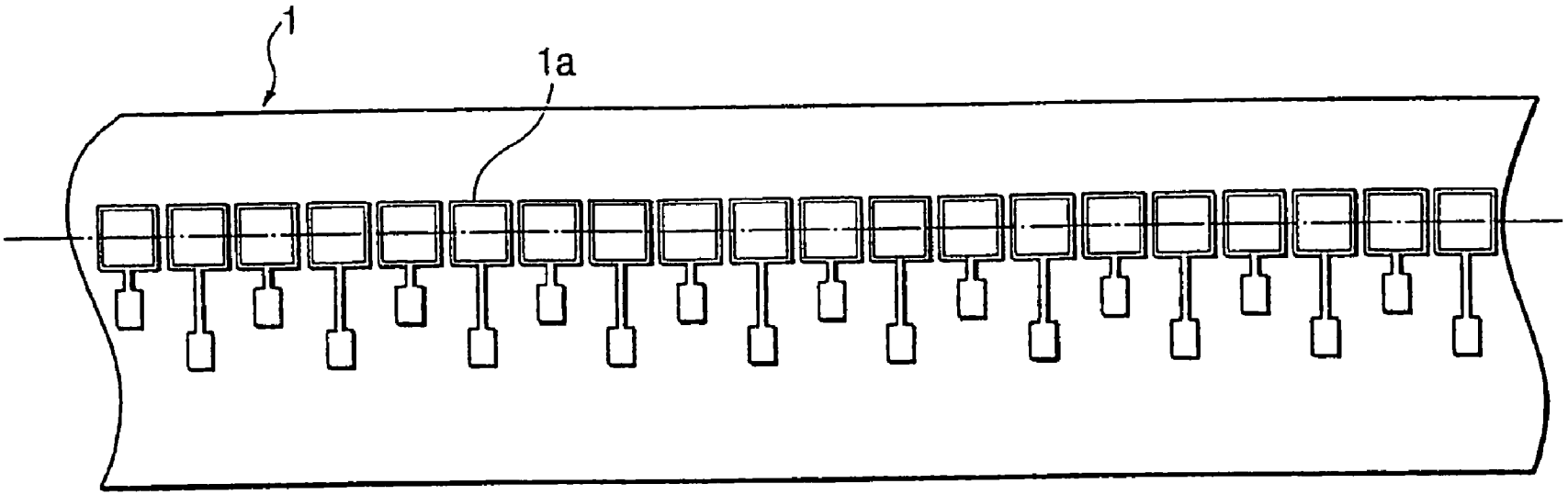
FIG. 7 PRIOR ART
FIG. 7 is a schematic diagram of an LED arrangement according to the prior art.
Figure 8:
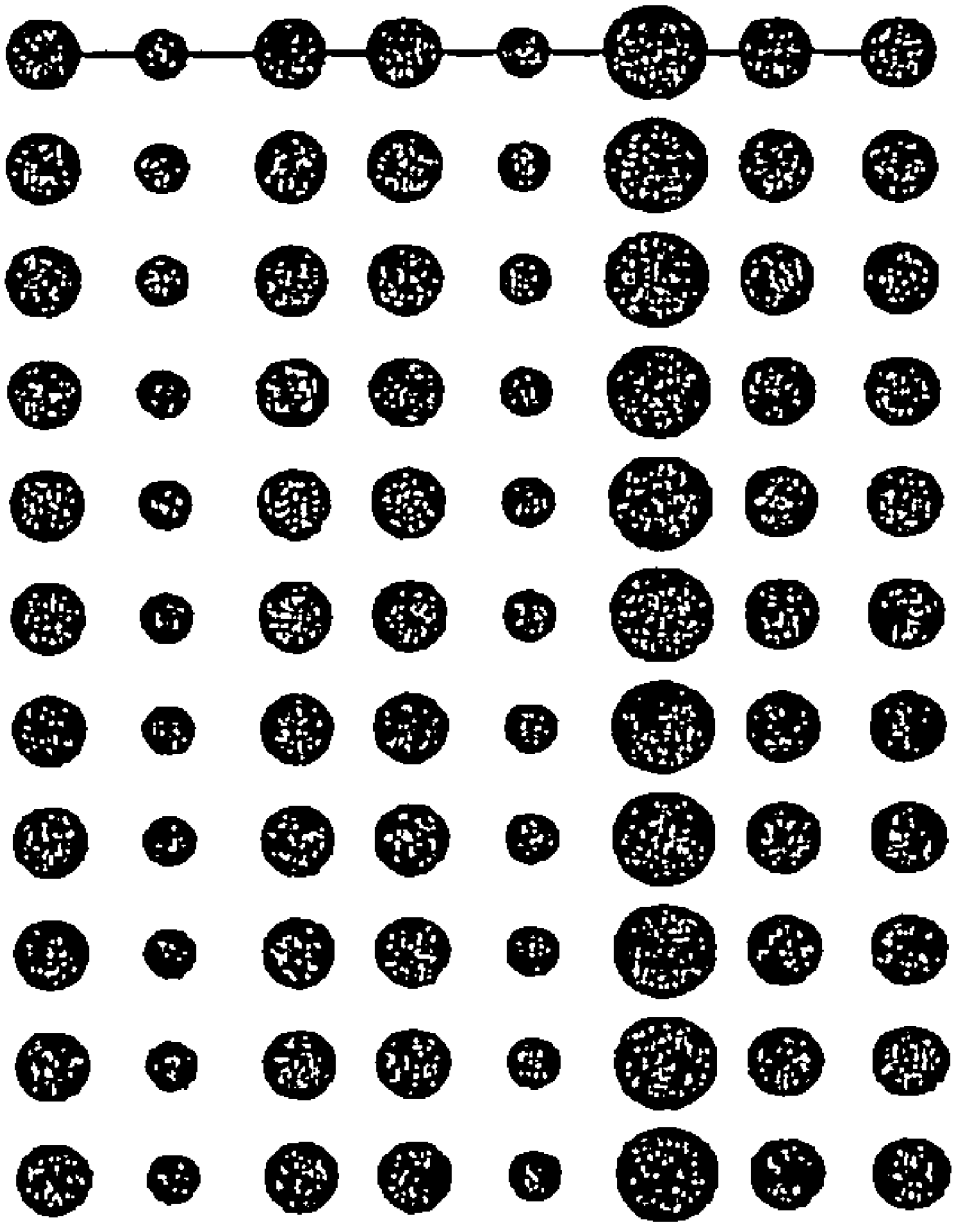
FIG. 8 PRIOR ART
FIG. 8 is a schematic diagram of the output pattern of an image forming apparatus according to the prior art.
Figure 9:
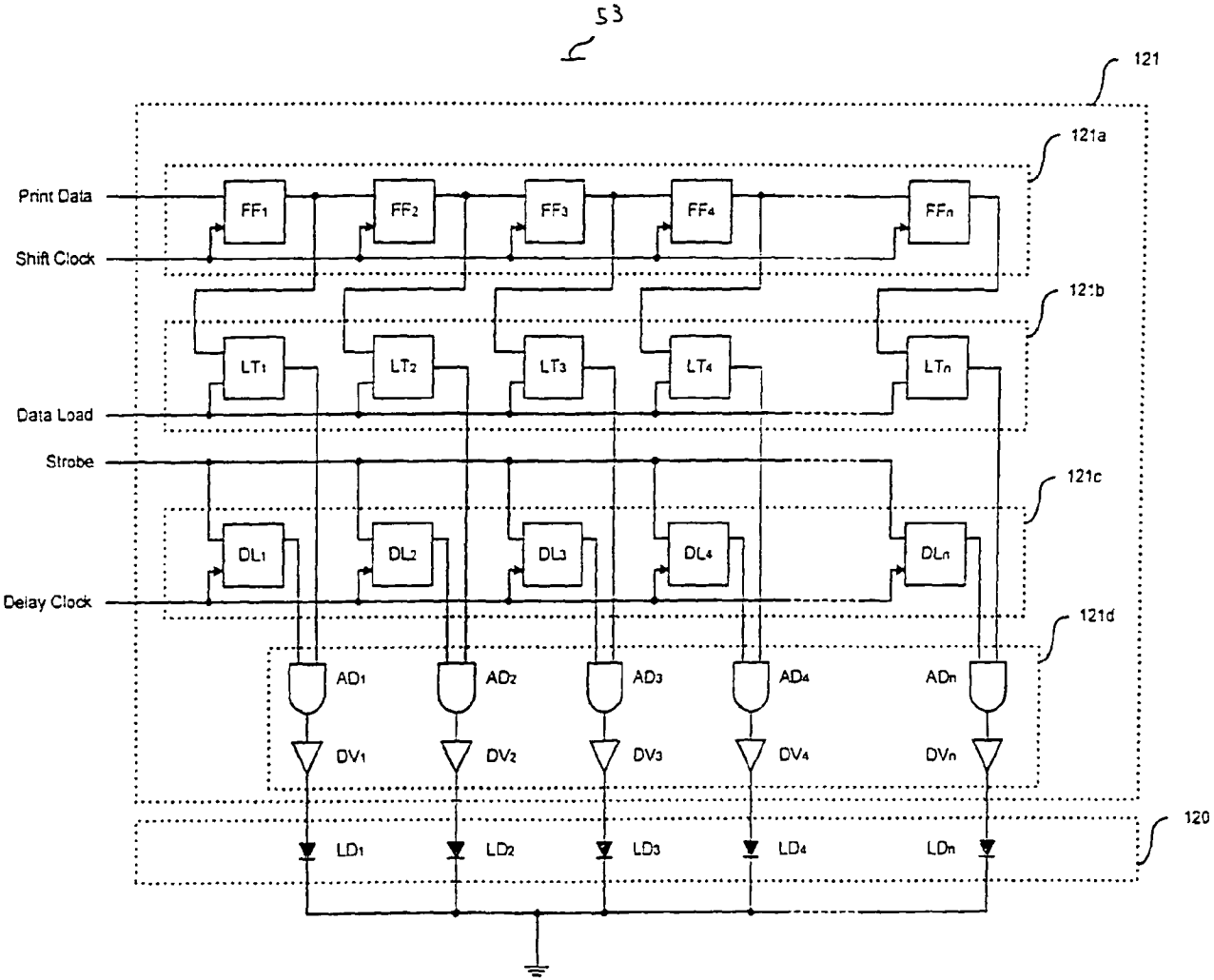
FIG. 9 is a block diagram of a drive circuit according to the second embodiment of the invention.

FIG. 9 shows the construction of the print head 53 of the image forming apparatus 50 according to the second embodiment. The LEDs used in the print head 53 are arranged in the same way as in the conventional print head shown in FIG. 7, that is, the LEDs are not stepped in the sub-scanning direction.

In FIG. 9, the print head 53 is composed of a plurality of light emitting devices or an LED array 120, and a drive circuit or driver chip 121.

The driver chip 121 consists of a shift register 121*a*, a latch 121*b*, a delay section 121*c*, and a drive section 121*d*, which are provided such that each component of them corresponds to each LED (LD1, LD2, . . . , $LD_n$) of the LED array 120.

The shift register 121*a* is composed of a plurality of flip-flops (FF1, FF2, . . . , $FF_n$), stores inputted exposure data, and shifts in sequence according to a shift clock.

The latch 121*b* is composed of a plurality of memories (LT1, LT2, . . . , $LT_n$), and inputs and stores the exposure data in the corresponding flip-flops of the shift register 121*a* according to an inputted data load signal.

The delay section 121*c* is composed of a plurality of delay circuits (DL1, DL2, . . . , $DL_n$), inputs a strobe signal, which is a timing signal for the exposure, delays the strobe signal according to the amount of delay memorized therein in advance, and outputs the delayed strobe signal.

The drive section 121*d* is composed of a plurality of ANSD gates (AD1, AD2, . . . , $AD_n$) and a plurality of drivers (DV1, DV2, . . . , $DV_n$).

Only LD1 of the LED array 121 will be described below to simplify the description of the operation of the driver chip 121.

The exposure data stored in the flip-flop FF1 of the shift register 121*a* is inputted into and stored in the corresponding memory LT1 of the latch 121*b* according to the data load signal.

When the strobe or a timing signal for the exposure is inputted into the delay circuit DL1 of the delay section 121*c*, it is delayed by a period of time corresponding to the amount of delay (e.g., the number of count of a delay clock) memorized in advance in the delay circuit DL1. Then, the delayed strobe signal is outputted.

The AND gate AD1 of the drive section 121*d* receives the output from the memory LT1 and the output from the delay circuit DL1 and outputs the logic product of the two outputs into the driver DV1.

The drive DV1 drives the corresponding LED LD1 according to the output from the AND gate AD1.

If the amounts of delays stored in the delay circuits DL1 and DL2 of the delay section 121*c* are different, the corresponding LEDs LD1 and LD2 emit lights at different timings. As shown in FIG. 1, the photo-sensitive member 11 rotates with respect to the LED array 120 including the LEDs LD1 and LD2. Consequently, the different timings of lights emitted from the LEDs LD1 and LD2 make the exposed points on the photo-sensitive member 11 shift in the sub-scanning direction. Accordingly, the stepped image is formed on the photo-sensitive member 11 in the same way as the first embodiment.

As described above, even when the LED array including no stepped LEDs is used, it is possible to reduce the visible difference in the image density by making different from each other the amounts of delays memorized in the respective delay circuits of the delay section 121*c*.

In the print head and image forming apparatus according to the invention, a plurality of light emitting devices are arranged such that the adjacent light emitting devices are stepped from each other in the rotation direction of the photo-sensitive member, or a plurality of light emitting devices disposed linearly emit light at different timings each other by employing a delay mechanism. Consequently, it is possible to provide the output pattern capable of directing the human eyes in two dimensions, thus reducing the visible difference in the image density.

What is claimed is:

1. A print head comprising:

a plurality of light emitting element (LEE) array chips arranged in substantially regular intervals in a first direction, each of said LEE array chips including a plurality of LEE's arranged in predetermined intervals in said first direction; and a plurality of driver chips provided for driving each of said LEE's, wherein each of said LEE's is disposed with a deviation from adjacent LEE's in a second direction and said plurality of driver chips drive at least two of said LEE's at different positions in said second direction with the same timing.

2. The print head according to claim 1, wherein an extent of said deviation is determined such that said deviation provides spatial frequency characteristics exceeding a specific spatial frequency, wherein said spatial frequency characteristics are determined by distances in said first direction between one of said LEE's and the others of said LEE's and positioning differences in said second direction between said one of said LEE's and said others of said LEE's.

3. The print head according to claim 2, wherein said spatial frequency characteristics have characteristics of a line spectrum noise indicating specific spatial frequencies.

4. The print head according to claim 2, wherein said spatial frequency characteristics have a predetermined frequency band width.

5. The print head according to claim 4, wherein said spatial frequency characteristics have characteristics of a blue noise.

6. A print head comprising:

a plurality of light emitting element (LEE) array chips arranged in substantially regular intervals in a first direction, each of said LEE array chips including a predetermined number of LEE's with their light emitting sections linearly arranged in said first direction;

a plurality of memories provided one for each of said LEE's for storing information about a delayed time with respect to a reference light-emitting timing; and a plurality of driver circuits provided one for each of said LEE'S for driving said LEE's based on a strobe signal with a predetermined time period and said delayed time stored in said memories, wherein said information about said delayed time stored in said memories has such a deviation that LEE's with the same reference light emitting timing are driven with such different time periods that portions of driving times overlap each other.

7. The print head according to claim 6, wherein said delayed time stored in each of said memories is determined for every one of LEE's with predetermined distribution characteristics.

8. An image forming apparatus comprising:

a photosensitive member; and the print head according to claim 1.

9. An image forming apparatus comprising:

the print head according to claim 6;

a photosensitive member of which a surface is movable in said second direction with respect to said print head; and an image forming section for forming an image according to an electrostatic latent image formed on said surface of said photosensitive member.

* * * * *